US006318114B1

(12) United States Patent
Slaughter

(10) Patent No.: US 6,318,114 B1
(45) Date of Patent: Nov. 20, 2001

(54) RAPID COOLING FOOD CONTAINER

(76) Inventor: Marion W. Slaughter, 1902 Spillers, Houston, TX (US) 77047

( * ) Notice: Subject to any disclaimer, the term of this patent is extended or adjusted under 35 U.S.C. 154(b) by 0 days.

(21) Appl. No.: 09/799,396

(22) Filed: Mar. 6, 2001

(51) Int. Cl.[7] ..... F25D 3/08

(52) U.S. Cl. ..... 62/457.2; 62/457.7; 62/371; 62/530

(58) Field of Search ..... 62/457.2, 457.1, 62/457.7, 371, 530, 258, 259; 206/548, 545

(56) References Cited

U.S. PATENT DOCUMENTS

| | | | | |
|---|---|---|---|---|
| 2,632,311 | * | 3/1953 | Sullivan | 62/371 |
| 5,088,301 | * | 2/1992 | Piepenbrink | 62/457.6 |
| 6,145,333 | * | 11/2000 | Richmond et al. | 62/258 |
| 6,209,343 | * | 4/2001 | Owen | 62/457.2 |

* cited by examiner

*Primary Examiner*—Henry Bennett
*Assistant Examiner*—Melvin Jones
(74) *Attorney, Agent, or Firm*—Bill B. Berryhill

(57) ABSTRACT

A container for rapidly cooling and holding foods at safe temperatures for extended periods of time which includes an upwardly opening inner container in which foods may be placed and another container surrounding the inner container. An enclosed chamber is formed between the bottoms and side walls of the inner and outer containers and is provided with a slow-to-freeze, slow-to-thaw gelatinous material which may be frozen by placing the container in a low temperature freezer. The container is further characterized in that the bottom and walls of the inner container provide insulating properties which control the rate of heat transfer between the gelatinous material, when frozen, and foods placed in the container and further characterized in that the bottom and walls of the outer container provide insulating properties which substantially retard heat transfer between the gelatinous material, when frozen, and the ambient air which surrounds the container.

14 Claims, 2 Drawing Sheets

RAPID COOLING FOOD CONTAINER

BACKGROUND OF THE INVENTION

1. Field of the Invention

The field of the invention pertains to food containers. More specifically, the present invention pertains to containers for rapidly cooling cooked foods and holding the foods at safe temperatures for extended periods of time.

2. Description of the Prior Art

It is very important that foods which are cooked and stored for reheating be quickly and properly cooled to prevent growing of bacteria which can cause food poisoning. This is particularly important in restaurants and other food handling establishments. Improper cooling of potentially hazardous foods is a main cause of food borne illness. Most hazardous microorganisms are killed and/or deactivated by adequate cooking; but, improper cooling of such foods may result in rapid growth of such microorganisms. Some of the most severe of these hazardous microorganisms are: *Clostridium botulinum; Shiaella dysenteriae*; Salmonella; Hepatitis A and E; *Brucella abortus; Vibrio cholerae; Vibrio vulnificus; Toenia solium*; and *Trichinella spiralis*.

To eliminate such bacterial, viral and parasitic organisms, the U.S. Food and Drug Administration (FDA) have previously required that cooked foods be cooled from 140° F. to 70 F. within two hours and then from 70° F. to 45° F. within four hours. However, recent research has shown that some of the most hazardous microorganisms are still present below 45° F. Therefore, recent regulations require cooked foods to be cooled from 140° F. to 70° F. within two hours and from 70° F. to 41° F. within four hours.

During restaurant inspections, health department inspectors investigate potentially hazardous cooked foods and how they are cooled. They monitor foods which have been reheated or are in the process of being reheated by measuring temperature. They also investigate how such foods are cooled. Some particularly potentially hazardous foods include poultry, meat, fish, dairy products, eggs, stews, soups, dressing, chilis, chowders, sauces, quiches, mousses, chiffons, etc. It is very important that such foods be properly cooled.

Most commercially available refrigerators cool at ambient temperatures of 45° F. and are not capable of complying with the new regulations which require that the food be cooled to 41° F. Although cooling to 41° can be accomplished, it requires expensive chilling equipment designed to cool faster than standard refrigerators. At the present time, many restaurants and other food service establishments cannot afford such units. For this reason, they utilize time and labor intensive methods such as:

1. placing food into shallow pans,
2. dividing the food into smaller or thinner portions,
3. continuously stirring food in a container placed in an ice water bath (a very time consuming method which runs the risk of splashing ice water into the food and contaminating it),
4. using chilled paddles to stir the food,
5. placing the food in shallow pans into a freezer or refrigerator (an impractical method which raises the ambient temperature of the refrigerator or freezer and puts other food products at risk of bacterial contamination), and
6. adding ice as an ingredient (diluting the flavor and consistency of the food).

The FDA recommends that food never be cooled at room temperature and that food cooled by the above methods will cool faster if uncovered but must be covered tightly as soon as it reaches 70° F. and that food which is set inside a walk-in cooler to cool must be covered loosely until it has reached 41° F. when it must be tightly covered.

Obviously, these are time and labor intensive methods which may also run the risk of further food contamination or dilution. Until better refrigeration units are manufactured and available to these establishments, better and less costly food chilling containers and/or methods are needed.

SUMMARY OF THE PRESENT INVENTION

The present invention provides a container for rapidly cooling and holding foods at safe temperatures for extended periods of time. The container includes an upwardly opening inner container providing an inner bottom and upwardly extending inner side walls and an outer container providing an outer bottom and upwardly extending outer side walls surrounding the inner container. An enclosed chamber is formed between the bottom and sides of the inner and outer containers and is provided with a slow-to-freeze. slow-to-thaw gelatinous material which may be frozen by placing the container in a low temperature freezer. The container also includes a removable lid for covering the opening of the inner container. The lid has a lower wall and an upper wall between which is an enclosed space in which is also provided a slow-to-freeze, slow-to-thaw Gelatinous material.

The container is further characterized in that the bottom and inner side walls of the inner container and the lower wall of the lid provide insulating properties which control the rate of heat transfer between the gelatinous material and the foods placed in the container. The bottom and outer side walls of the outer container and the upper wall of the lid provide insulating properties which substantially retard heat transfer between the gelatinous material and the ambient air which surrounds the container.

The insulating properties of the bottom and outer side walls of the outer container and the upper wall of the lid are substantially greater than the insulating properties of the bottom and inner side walls of the inner container and the lower wall of the lid. Thus, foods placed in the container are rapidly cooled by the frozen gelatinous material; yet, there is little transfer of heat between the ambient air surrounding the container and the gelatinous material. In fact, the gelatinous material, when frozen to 0° F., will reduce temperature of foods placed in the container at 140° to 70° F. within a period of two hours and will further reduce the temperature thereof from 70° to 41° F. within an additional four hours. This fully complies with the most recent U.S. FDA food regulations of 1999. Furthermore, cooling of the food is totally accomplished while the food is covered by the lid and protected from outside contamination.

The cooling container of the present invention is relatively inexpensive and is affordable by restaurants and other food service establishments which otherwise could not afford the expensive rapid chilling units capable of reducing temperature as required by the new FDA regulations. Other objects and advantages of the invention will be apparent from reading the description which follows in conjunction with the accompanying drawings.

DESCRIPTION OF PREFERRED EMBODIMENTS

Figure 1:
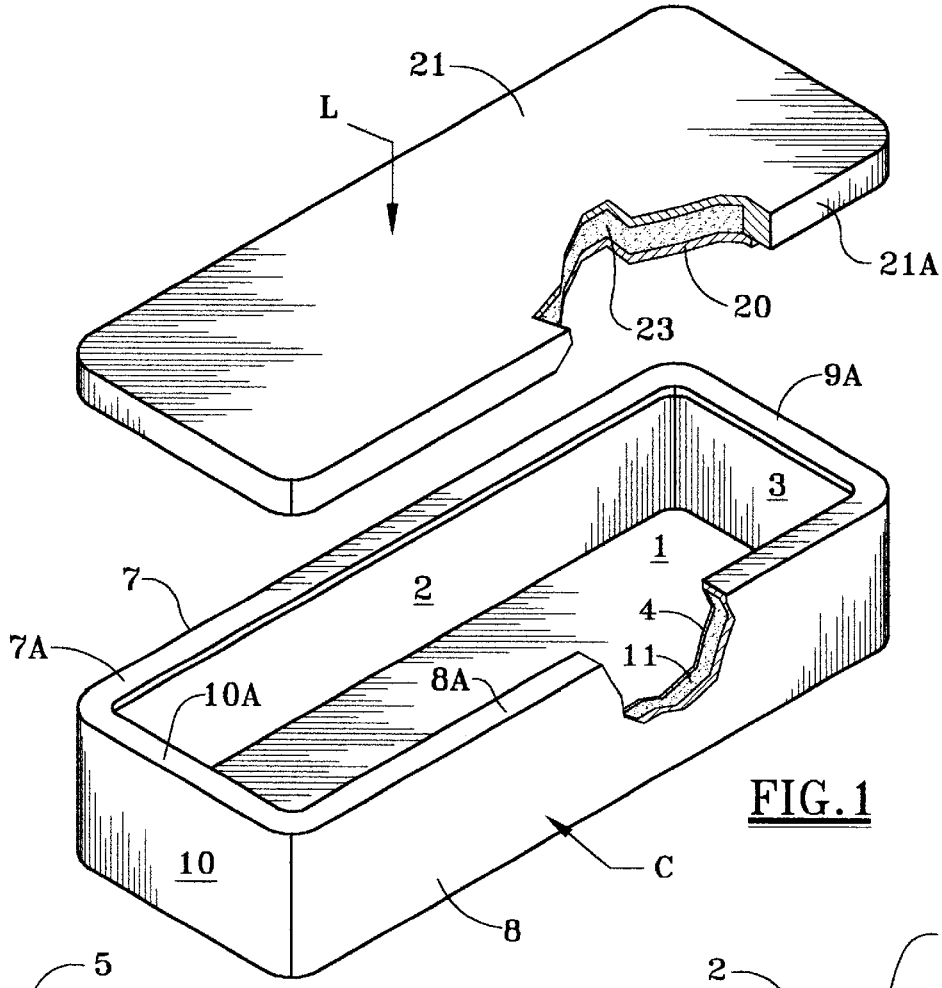
FIG. 1 is an isometric drawing of the food container of the present invention, parts of which are cut away for better understanding thereof, according to a preferred embodiment of the invention.
Figure 2:
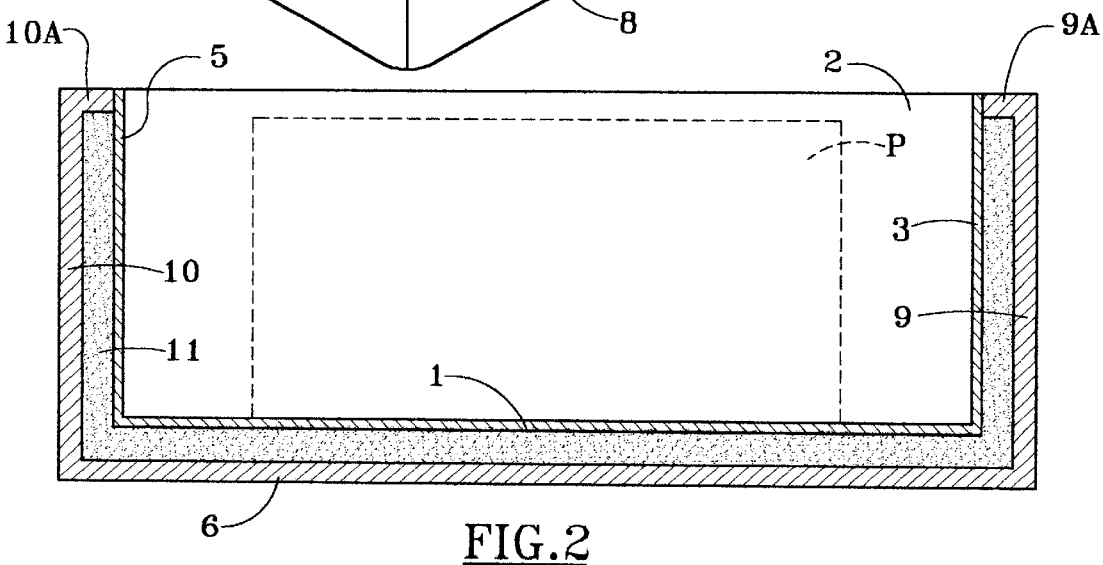
FIG. 2 is a side elevation view, in section, of the food container of FIG. 1, with lid removed, according to a preferred embodiment of the invention.
Figure 3:
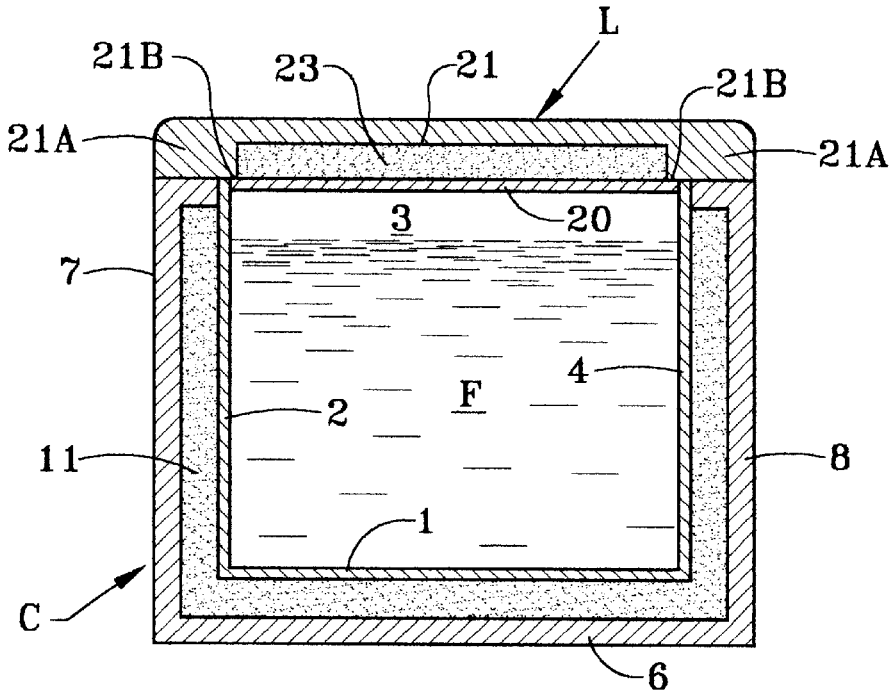
FIG. 3 is an end elevation, in section, of the food container of FIGS. 1 and 2, showing the lid in place and food within the container.

Referring first to FIGS. 1, 2 and 3, there is shown a container for rapidly cooling and holding foods at safe temperatures for extended periods of time. The container comprises a composite container C and a composite lid L. The composite container C comprises an upwardly opening inner container which provides an inner bottom 1 and upwardly extending inner side walls 2, 3, 4, and 5. The composite container C also includes an outer container which provides an outer bottom 6 and upwardly extending outer side walls 7, 8, 9, and 10.

The outer bottom 6 and outer side walls 7, 8, 9 and 10 of the outer container surrounds the inner container but are spaced therefrom to leave an enclosed chamber 11 therebetween. The upper extremity of the enclosed chamber 11 may be closed in any manner. In the exemplary embodiment, the upwardly extending side walls 7, 8, 9, and 10 of the outer container are provided with inwardly projecting lips or flange portions 7*a*, 8*a*, 9*a*, 10*a*, which engage the inner side walls 2, 3, 4, 5 of the inner container.

The enclosed chamber 11 is filled with a slow-to-freeze, slow-to-thaw refrigerant gel which is formulated to freeze, in a 0° F. freezer, within eight hours and when frozen will thaw in approximately twelve hours. In the container of the present invention, the refrigerant gel in the enclosed chamber 11 will facilitate heat transfer for a twelve hour period. Beginning a 0° F., the frozen gel will be around 40° F. after the eighth hour of cooling.

As best seen in FIGS. 1 and 3. the composite lid L has a lower wall 20 and an upper wall 21 between which is an enclosed space 23 which may also be provided with a slow-to-freeze, slow-to-thaw gelatinous material such as the material placed in the enclosed chamber 11 of the composite container C. In the exemplary embodiment, the upper wall 21 is wider around its edges providing downwardly extending portions 21*a* which may be affixed to the lower wall 20 as at 21*b*. In the exemplary embodiment, the width and length of the lower wall 20 are selected so as to be slightly less than the opening of the inner container engaging the inner side walls 2, 3, 4, and 5 thereof in a sliding and sealing fit. This allows the composite lid L to be removed from the composite container C for filling with food such as the food F shown in FIG. 3.

Like the bottom and inner side walls of the inner container of the composite container C, the lower wall 20 of the composite lid L provides insulating properties which control the rate of heat transfer between the gelatinous material in the space 23, when frozen, and the foods F placed in the container. Like the bottom and outer side walls 6, 7, 8, 9, and 10 of the outer container of the composite container C, the upper wall 21 provides insulating properties which substantially retard heat transfer between the gelatinous material in the space 23 and the ambient air which surrounds the container C.

Figure 4:
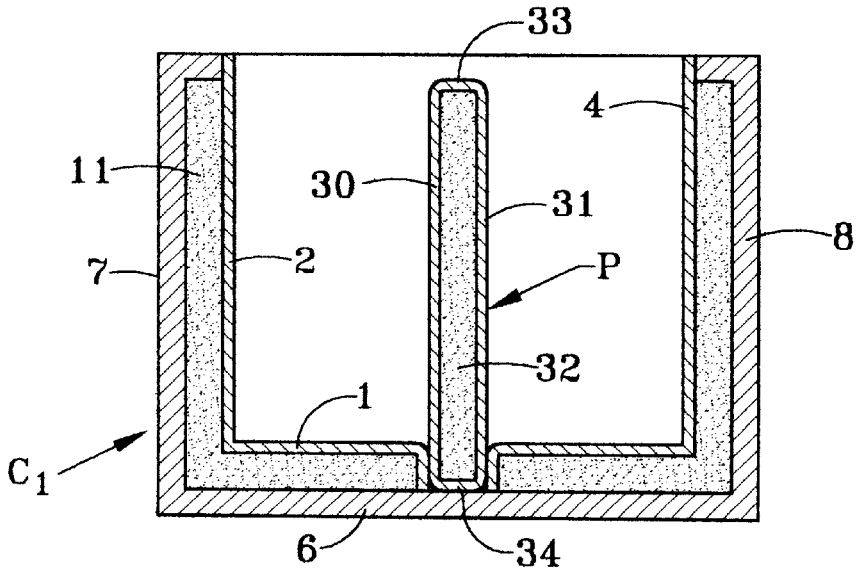
FIG. 4 is an end elevation; in section, of a food container, with lid removed, according to an alternate embodiment of the invention.

An alternate embodiment of the invention is illustrated in FIG. 4. In the embodiment of FIG. 4, the composite container $C_1$ is modified to accommodate a panel member P which is shown in cross-section in FIG. 4. The side of the panel member P is also illustrated by dotted lines in FIG. 2. The panel member P comprises a pair of spaced apart side walls 30 and 31 between which is an enclosed space 32 filled with a slow-to-freeze, slow-to-thaw gelatinous material such as the materials placed in the chamber 11 and the enclosed space 23 of composite lid L. Edge walls 33, 34 surround the panel member P so that the space 32 is totally enclosed. Like the bottom and inner side walls 1–5 of the inner container of the composite container C or $C_1$ and like the lower wall 20 of the composite lid L, the side and edge walls 30–34 of the panel member P provide insulating properties which control the rate of heat transfer between the gelatinous material within the enclosed space 32 and foods which may be placed in the container.

The length of the panel member P, as best seen in FIG. 2, is less than the length of the inner container, leaving spaces at opposite ends of the panel member P allowing the panel member P to be totally surrounded by foods in the container and allowing for stirring of the foods if desired. The panel member P may be inserted through the opening of the inner container for substantially vertical disposition therein. It can be supported in this disposition in any number of ways. In the exemplary embodiment of FIG. 4, the bottom 1 of the inner container is formed to provide a slot engageable by the lower edge of the panel member P.

As previously indicated, the bottom 1 and inner side walls 2–5 which form the inner container and the bottom 6 and outer side walls 7–10 which form the outer container of the composite container C have certain insulating properties. Likewise the lower wall 20 and the upper wall 21 of the composite lid L also have certain insulating properties. It is very important that the insulating properties of the outer container and the upper wall of the lid be substantially greater than those of the inner container and the lower wall of the lid. The measure of a materials ability to resist heat transfer or flow, sometimes referred to as resistance value, is expressed as its R-value. In the present invention, it is therefore important that the R-value of the bottom 6 and side walls 7–10 of the outer container and the upper wall 21 of the lid be substantially greater than the bottom 1 and side walls 2–5 of the inner container and the bottom wall 20 of the lid, respectively. The outer bottom and side walls of the composite container C and the upper wall of the composite lid L should be from two to ten times greater than the R-value of the bottom and inner side walls of the inner container and the bottom wall of the composite lid. In a preferred embodiment of the invention the thermal resistance (R-value) of the outer walls of the container C and the lid L are five times the thermal resistance (R-value) of the inner walls of the container and the lower wall of the lid.

The greater insulation of the outer walls will prevent the transfer of heat from the ambient air. The lesser insulation of the inner walls is sufficient to prevent uncontrollable transfer of heat from the food in the container to the frozen gel in the enclosed chamber 11 and space 23 while still maintaining an even transfer of heat from the food to cool the food to the proper temperatures within the required time.

The insulating properties of the bottom and side walls of the inner and outer containers and the walls of the lid might be provided by manufacturing these components of materials which provide the necessary heat resistance value, i.e. R-value. On the other hand, these bottoms and side walls may be covered with insulating material with suitable R-value characteristics. There are a number of materials suitable for this purpose such as those manufactured by the 3-M Company and DuPont under the trademarks THINSULATE and MYLAR, respectively. Another particular suitable material is manufactured by Superior Products under the trademark THERMSEAL. Some of these materials, such as THERMSEAL, may be painted, by spraying or brushing, on the sides and walls of the respective containers. In such a case, one side of the bottom 1 and side walls 2–5 of the inner container and the lower wall 20 of the lid could be painted with a single layer of insulating paint while the bottom and outer side walls of the outer container and the upper wall of the lid L could be painted with five layers of the insulating paint resulting in an approximately five to one R-value ratio. A typical value of the inner insulation might be 0.61 while the R-value for the outer insulation might be 3.05 resulting in a 5 to 1 ratio.

For the purposes of this description and the claims which follow, the terms which refer to the "insulating properties" of the bottom and side walls of the inner and outer containers of the composite container C and the lower and upper walls of the composite lid L are intended to encompass any of the above mentioned materials for providing such properties, i.e. the materials of which the bottoms, and side walls are made or such materials with other insulating materials applied thereto whether they are adhered thereto or painted thereon.

In utilizing the container of the present invention, the composite container C and the composite lid L are first placed in a freezer which is capable of freezing the refrigerant gel in the enclosed chamber 11 and the space 23 to a temperature of 0° F. This would typically require eight hours. When needed, the container would be removed from the freezer and cooked food placed therein, typically at 140° F. The composite lid L would then be placed on the composite container C, as shown in FIG. 3, sealing the food F therein from outside contamination. Heat would then be transferred from the food F, at a controlled rate, through the bottom 1 and sides 2–5 of the inner container and through the bottom wall 20 of the lid L, reducing the temperature of the food from 140° F. to 70° F. within two hours. A further reduction in temperature from 70° F. to 41° F. would occur within four hours. This would meet the most recent U.S. FDA regulations and essentially eliminate the growth of serious hazardous microorganisms, particularly those which are not presently eliminated by cooling to 45° F. as with most current cooling methods.

If desired. a container such as the composite container $C_1$ of FIG. 4 can be utilized with a panel member P. In such cases; the panel member P would also be placed in the freezer so that the refrigerant gel within the space 32 would be frozen to 0° F. before use.

Thus, the food container of the present invention is extremely effective and efficient in rapidly cooling cooked foods and holding the foods at safe temperatures for extended periods of time. Food at a temperature of 140° F. is reduced to a temperature of 41° F. within six hours meeting the stringent requirements of recently enacted U.S. FDA regulations. Yet the container of the present invention is relatively simple to manufacture, easy to use and much less expensive than the chilling units of the prior art which are necessary to meet these recent regulations.

Two preferred embodiments of the invention have been described herein. However, many variations thereof may be made by those skilled in the art without departing from the spirit of the invention. Accordingly, it is intended that the scope of the invention be limited only by the claims which follow.

What is claimed is:

1. A container for rapidly cooling and holding foods at safe temperatures for extended periods of time comprising:

an upwardly opening inner container in which said foods may be placed, said inner container providing an inner bottom and upwardly extending inner side walls;

another container, providing an outer bottom and upwardly extending outer side walls, surrounding said inner container; and an enclosed chamber formed between said bottom and side walls of said inner and outer containers in which is provided a slow-to-freeze, slow-to-thaw gelatinous material which may be frozen by placing said container in a low temperature freezer;

said container being further characterized in that said bottom and inner side walls of said inner container provide insulating properties which control the rate of heat transfer between said gelatinous material, when frozen, and said foods placed in said container and further characterized in that said bottom and outer side walls of said outer container provide insulating properties which substantially retard heat transfer between said gelatinous material, when frozen, and the ambient air which surrounds said container.

2. The food container of claim 1 in which the R-value of said bottom and outer side walls of said outer container is at least twice as great as the R-value of said bottom and inner side walls of said inner container.

3. The food container of claim 2 in which the R-value of said bottom and outer side walls of said outer container is from two to ten times greater than the R-value of said bottom and inner side walls of said inner container.

4. The food container of claim 1 in which said gelatinous material, when frozen to 0° F., is capable of reducing the temperature of said foods, when placed therein at 140° F., to 70° F. within a period of two hours and of further reducing the temperature thereof from 70° F. to 41° F. within an additional four hours.

5. The food container of claim 1 in which said slow-to-freeze, slow-to-thaw gelatinous material, when placed in a low temperature freezer may be frozen at 0° F. in a period of eight hours and when removed from said freezer may thaw in a period of approximately twelve hours.

6. The food container of claim 1 which includes a removable lid for covering said opening of said inner container, said lid having a lower wall and an upper wall between which is an enclosed space in which is provided a slow-to-freeze, slow-to-thaw gelatinous material which may be frozen by placing said lid in a low temperature freezer; said lid being further characterized in that said lower wall provides insulating properties which control the rate of heat transfer between said gelatinous material, when frozen, and said foods placed in said container and further characterized in that said upper wall provides insulating properties which substantially retard heat transfer between said gelatinous material, when frozen, and the ambient air which surrounds said container.

7. The food container of claim 6 in which the R-value of said upper wall of said lid is at least twice as great as the R-value of said lower wall thereof.

8. The food container of claim 7 in which the R-value of said upper wall of said lid is two to ten times greater than the R-value of said lower wall thereof.

9. The food container of claim 6 in which said slow-to-freeze, slow-to-thaw gelatinous material, when placed in a low temperature freezer may be frozen at 0° F. in a period of eight hours and when removed from said freezer may thaw in a period of approximately twelve hours.

10. The food container of claim 9 in which said gelatinous material, when frozen to 0° F., is capable of reducing the temperature of said foods, when placed therein at 140° F., to 70° F. within a period of two hours and of further reducing the temperature thereof from 70° F. to 41° F. within an additional four hours.

11. The food container of claim 1 which comprises a panel member which may be inserted through said opening of said inner container for substantially vertical disposition therein, said panel member comprising a pair of upwardly extending spaced apart side walls between which is an enclosed space filled with a slow-to-freeze, slow-to-thaw gelatinous material which may be frozen by placing said panel member in a low temperature freezer, said side walls of said panel member providing insulating properties which control the rate of heat transfer between said gelatinous material in said enclosed space, when frozen, and said foods placed in said container.

12. The food container of claim 11 in which said insulating properties of said panel member side walls are substantially the same as the insulating properties of said bottom and inner side walls of said inner container.

13. The food container of claim 11 in which the length of said panel member is less than the length of inner container, leaving spaces at opposite ends of said panel member, allowing said panel member to be totally surrounded by said foods in said container.

14. The food container of claim 11 in which said bottom of said inner container is provided with an elongated slot engageable by a lower edge of said panel member for supporting said panel member in said substantially vertical disposition therein.

* * * * *